US007195006B2

(12) United States Patent
Khair et al.

(10) Patent No.: US 7,195,006 B2
(45) Date of Patent: Mar. 27, 2007

(54) EXHAUST GAS RECIRCULATION SYSTEM WITH CONTROL OF EGR GAS TEMPERATURE

(75) Inventors: Magdi K. Khair, San Antonio, TX (US); Yiqun Huang, San Antonio, TX (US); Christopher A. Sharp, San Antonio, TX (US); Cynthia C. Webb, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 11/288,891

(22) Filed: Nov. 29, 2005

(65) Prior Publication Data

US 2006/0137665 A1 Jun. 29, 2006

Related U.S. Application Data

(60) Provisional application No. 60/631,349, filed on Nov. 29, 2004.

(51) Int. Cl.

| | |
|---|---|
| ***F02M 25/07*** | (2006.01) |
| ***F02B 47/08*** | (2006.01) |
| ***F02B 33/44*** | (2006.01) |
| *F28F 27/02* | (2006.01) |

(52) U.S. Cl. ..... 123/568.12; 60/605.2

(58) Field of Classification Search ..... 123/568.11, 123/568.12, 568.21; 701/108; 60/274, 278, 60/288, 299, 300, 605.2; 165/103
See application file for complete search history.

(56) References Cited

U.S. PATENT DOCUMENTS

| | | | | |
|---|---|---|---|---|
| 5,617,726 | A | 4/1997 | Sheridan et al. | 60/605.2 |
| 6,038,860 | A * | 3/2000 | Bailey | 60/605.2 |
| 6,138,649 | A | 10/2000 | Khair et al. | 123/568.12 |
| 6,367,256 | B1 | 4/2002 | McKee | 60/605.2 |
| 6,725,848 | B2 * | 4/2004 | Ramamurthy et al. | 123/568.22 |
| 6,742,506 | B1 | 6/2004 | Grandin et al. | 123/568.12 |
| 6,804,952 | B2 | 10/2004 | Sasaki et al. | 60/284 |
| 6,826,903 | B2 | 12/2004 | Yahata et al. | 60/278 |
| 6,837,043 | B2 * | 1/2005 | Nakatani et al. | 60/288 |
| 6,868,840 | B2 * | 3/2005 | Lewallen | 123/563 |
| 6,874,316 | B2 * | 4/2005 | Nakatani | 60/288 |
| 6,976,480 | B2 * | 12/2005 | Miyoshi et al. | 123/568.12 |
| 7,076,945 | B2 * | 7/2006 | Sisken et al. | 60/274 |
| 2004/0107949 | A1 * | 6/2004 | Miyoshi et al. | 123/568.12 |

FOREIGN PATENT DOCUMENTS

| | | | | |
|---|---|---|---|---|
| JP | 2001323844 A | * | 11/2001 | 123/568.12 |

* cited by examiner

*Primary Examiner*—Willis R. Wolfe, Jr.
(74) *Attorney, Agent, or Firm*—Baker Botts, L.L.P.

(57) ABSTRACT

A method and system for controlling the temperature of recirculated exhaust gas in an exhaust gas recirculation (EGR) system, such as those used in connection with diesel engines. An EGR loop (which may be either a high pressure loop or a low pressure loop) has a dual-leg segment with an EGR cooler on one leg and an EGR heater on the other leg. By means of a valve, the EGR gas may be diverted to either one leg or the other, thereby providing either cooled or heated EGR gas to the engine.

21 Claims, 2 Drawing Sheets

EXHAUST GAS RECIRCULATION SYSTEM WITH CONTROL OF EGR GAS TEMPERATURE

CROSS-REFERENCE TO RELATED APPLICATIONS

This application claims the benefit of U.S. Provisional Application Ser. No. 60/631,349 filed Nov. 29, 2004, which is incorporated herein by reference in its entirety.

TECHNICAL FIELD OF THE INVENTION

This invention relates to exhaust gas recirculation (EGR) systems associated with internal combustion engines, and more particularly to an EGR system that provides temperature control of EGR gas to a diesel engine.

BACKGROUND OF THE INVENTION

Diesel engine technology has made good progress over the last two decades. In addition to having good fuel economy and durability, diesel engines have gained a good reputation for performance and low hydrocarbon and carbon monoxide emissions. However, diesel engines have presented engineers with the formidable challenge of reducing nitric oxides (NOx) and particulate matter.

Exhaust gas recirculation (EGR) has been used for more than three decades in internal combustion engines to reduce NOx through increasing the specific heat coefficient of intake charge, which lowers the combustion temperature and dilutes intake air to slow down combustion. Recirculation of exhaust gas is usually accomplished by routing a portion of the exhaust gas back to the intake manifold where it is inducted into the cylinders along with charge air.

So far, despite its advantages, the use of EGR has fallen short of achieving desired diesel engine emission limits. Engineers have resorted to auxiliary emission control devices (also known as aftertreatment devices) to help meet the emissions reduction challenge. Typically, these devices require elevated exhaust temperatures to operate in an efficient manner.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to controlling exhaust temperature to provide for efficient emissions treatment. More specifically, a method and system are disclosed for using exhaust gas recirculation (EGR) to control the primary exhaust temperature in an internal combustion engine, such as a diesel engine. Although the system is especially designed for automobile engines, it may be implemented in various other stationary or mobile engines.

The method increases the range of EGR utility to provide heated or cooled EGR according to engine control needs. As explained below, the method combines the advantages of both high temperature and low temperature EGR at different engine operating conditions to reduce the levels of NOx and particulate matter emissions.

Figure 1:
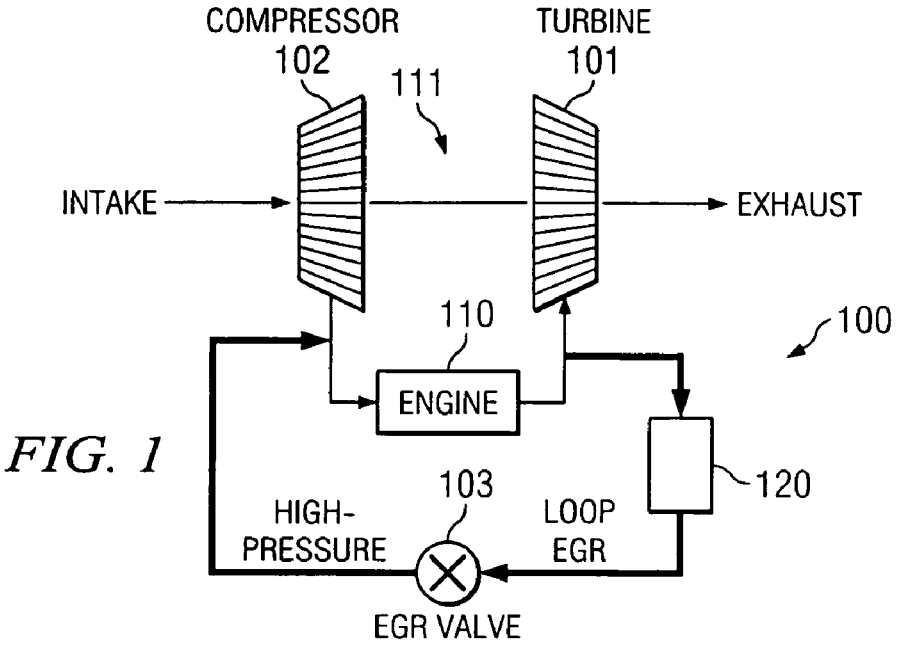
FIG. 1 illustrates a conventional high pressure loop (HPL) EGR system.
Figure 2:
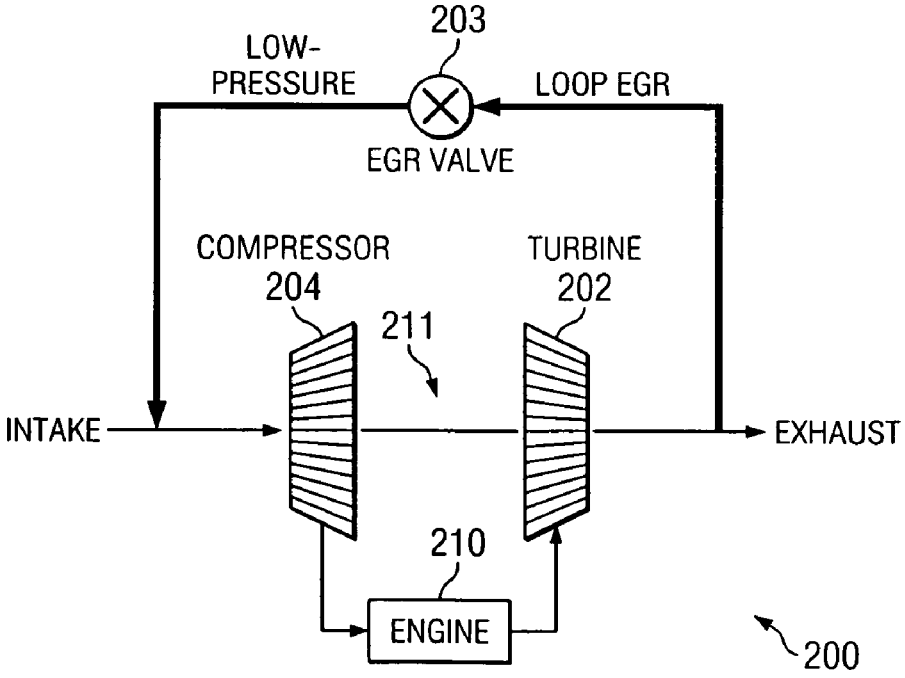
FIG. 2 illustrates a conventional low pressure low (LPL) EGR system.

FIGS. 1 and 2 illustrate the two conventional EGR configurations. Both are used with a diesel engine 110 having a turbocharger 111.

FIG. 1 illustrates a high-pressure loop (HPL) EGR system 100. Exhaust is extracted upstream of the turbocharger's turbine 101, and routed to the intake manifold 102 through an EGR control valve 103.

FIG. 2 illustrates a low-pressure loop (LPL) EGR system 200. Exhaust is extracted downstream of the turbine 201, and routed back to the upstream side of the turbocharger's compressor 204, and also through an EGR control valve 203. The EGR gas is drawn toward the intake manifold of engine 210 by a vacuum generated by intake throttling. It is compressed by compressor 204.

In both systems 100 and 200, the recirculated exhaust gas may be filtered by a particulate filter (not shown) so the EGR gas is mostly soot free. Also, both types of EGR systems 100 and 200 may use a cooler, such as cooler 120 illustrated in FIG. 1. Cooler 120 typically uses jacket water as a cooling medium.

One significant EGR operating parameter is the rate of EGR input to the manifold. Because of increasing stringency of emissions control standards, EGR intake rates have been increased relative to charge air intake. At some conditions, high EGR rates will play a role in changing the standard diesel combustion into a low temperature combustion regime where NOx and soot formation are suppressed by the low combustion temperature.

The engine load is a further consideration for EGR effectiveness. At higher loads, cooled EGR is desirable because it will further lower the intake charge temperature and increase the EGR gas density so as to increase the EGR mass. However, at low loads, a higher EGR rate can cause unstable combustion. But because higher EGR intake temperature will stabilize the combustion, higher EGR temperature is desirable.

Another factor affecting EGR use is whether aftertreatment devices are used. Recently, catalyzed aftertreatment devices have been used to reduce tailpipe emissions to regulated levels. To operate efficiently, the temperature of the catalyst must be maintained above a certain threshold level even at light load conditions.

EGR provides an alternative combustion, which features partially oxidized products such as high CO and HC in the engine out exhaust, to generate an exothermic reaction in aftertreatment system. However, at cold-start conditions, the catalysts are well-below their effective operating temperature threshold, therefore, a solution is required to minimize the time for the catalyst to reach its light-off temperature.

Historically, when an aftertreatment device is used, an HPL EGR system 100 has been preferred over an LPL EGR system 100. The two main reasons for this preference are higher combustion temperature and less exhaust flow through the catalytic aftertreatment device.

Typical EGR systems in diesel engine applications are HPL EGR systems, such as system 100, cooled and with a valve to control flow rate. Such systems work well when the EGR is used to reduce NOx emissions during fuel lean combustion at normal operating temperatures.

On the other hand, an LPL EGR system, such as system 200, is generally cooler than an HPL EGR system 100. An LPL EGR system 200 has historically also been considered to be more effective especially at high load conditions. Thus, an LPL EGR system 100 is suitable in high load engine conditions, as well as when more EGR volume is needed than HPL EGR alone can deliver.

Figure 3:
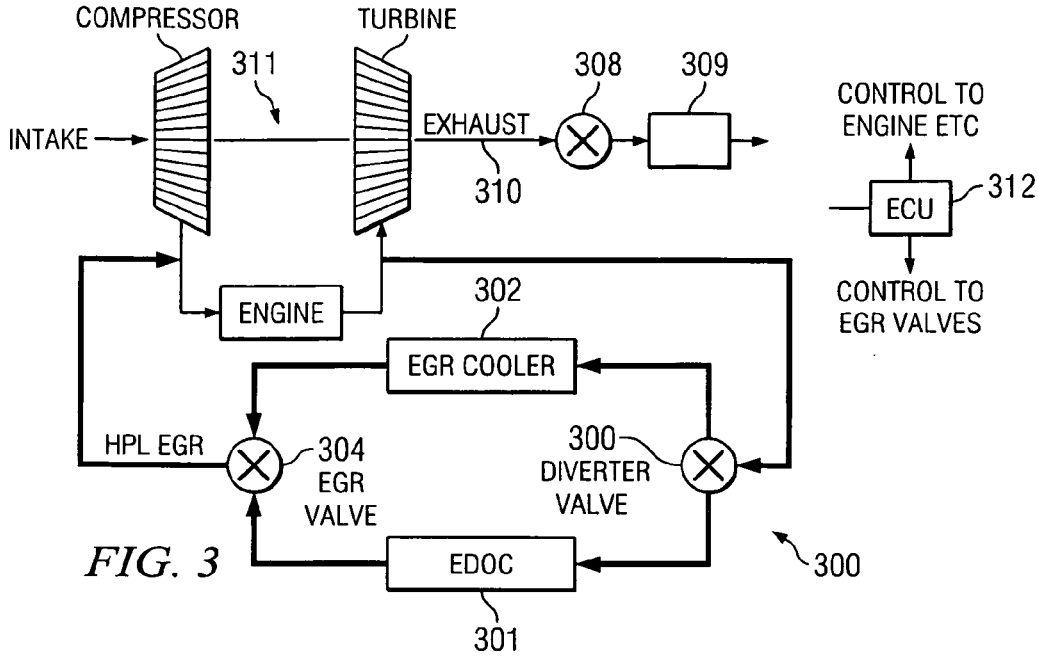
FIG. 3 illustrates a modified HPL EGR system in accordance with the invention.

FIG. 3 illustrates a modified HPL EGR system 300 in accordance with the invention. As explained below, system 300 controls combustion quality. This affects the exhaust gas temperature for purposes of exhaust gas treatment devices, such as device 309 in the primary exhaust line 310.

System 300 is a dual-leg EGR loop, with an EGR heater (here a diesel oxidation catalyst) 301 in one leg and an EGR cooler 302 in the other leg. In the example of this description, the EGR heater 301 is a diesel oxidation catalyst (EDOC), but other means for heating exhaust gas, such as electric, combustive, or heat transfer devices, could be used. EDOC 301 and cooler 302 may be conventional devices, known in the art of engine exhaust treatment systems, or they may be devices similarly functioning devices developed in the future.

The exhaust gas flow through the EGR system 300 is controlled by two valves 303 and 304. Valves 303 and 304 control the relative flow of EGR through one leg relative to the other. The flow will either go through the EDOC leg, the EGR cooler leg, through both legs, or there can be no EGR flow at all. An additional exhaust valve 308 may also be installed downstream of the turbocharger 311 to increase the exhaust backpressure thereby increasing the EGR flow.

Valves 303 and 304 are controlled electronically by a controller, here shown as the engine control unit (ECU) 312. When the primary exhaust system catalyst 309 is below its light-off temperature, EGR gas is directed through EDOC 301. This is accomplished by means of a diverter valve 303 placed upstream of the dual EGR legs.

During normal engine operation, valve 303 is set to cause EGR gas to go through cooler 302. Cooling the EGR gas increases its density and lowers the intake charge temperature. Cooling the EGR gas also reduces the volume it occupies in the combustion chamber, thus allowing more fresh air in the combustion chamber to curb the increase in smoke.

When valve 303 is set so that EGR gas goes through the leg with EDOC 301, EGR will bypass the EGR cooler 302 and remain at an elevated temperature. During cold-start conditions, the engine control unit 310 will command in-cylinder post-injection designed to inject during the expansion stroke of a 4-stroke internal combustion engine or retard main injection. This post-injection or retarded main injection will create additional heat, thus assisting in warming up the primary exhaust system catalyst 309 as well as EDOC 301.

Once the EDOC 301 reaches its warmed up temperature, it will also use EGR that is laden with unburned hydrocarbon from the incompletely burned post-injection. This process will cause an exothermic reaction, thereby increasing the EGR as well as the engine's intake air temperature. This may de-stabilize in-cylinder combustion and raise the exhaust gas temperature to further assist warming up the downstream primary catalyst 309. The exothermic reaction of hydrocarbons and oxygen across EDOC 301 will also reform the unburned hydrocarbons into lighter hydrocarbons, CO, and hydrogen, which react at lower temperatures to further facilitate primary catalyst light-off 309.

In an alternative embodiment of the invention, diverter valve 303 and EGR valve 304 may be controlled so that a portion of the EGR gas flows through both legs. This might permit a mix of cooled and heated EGR gas for specific temperature requirements.

Figure 4:
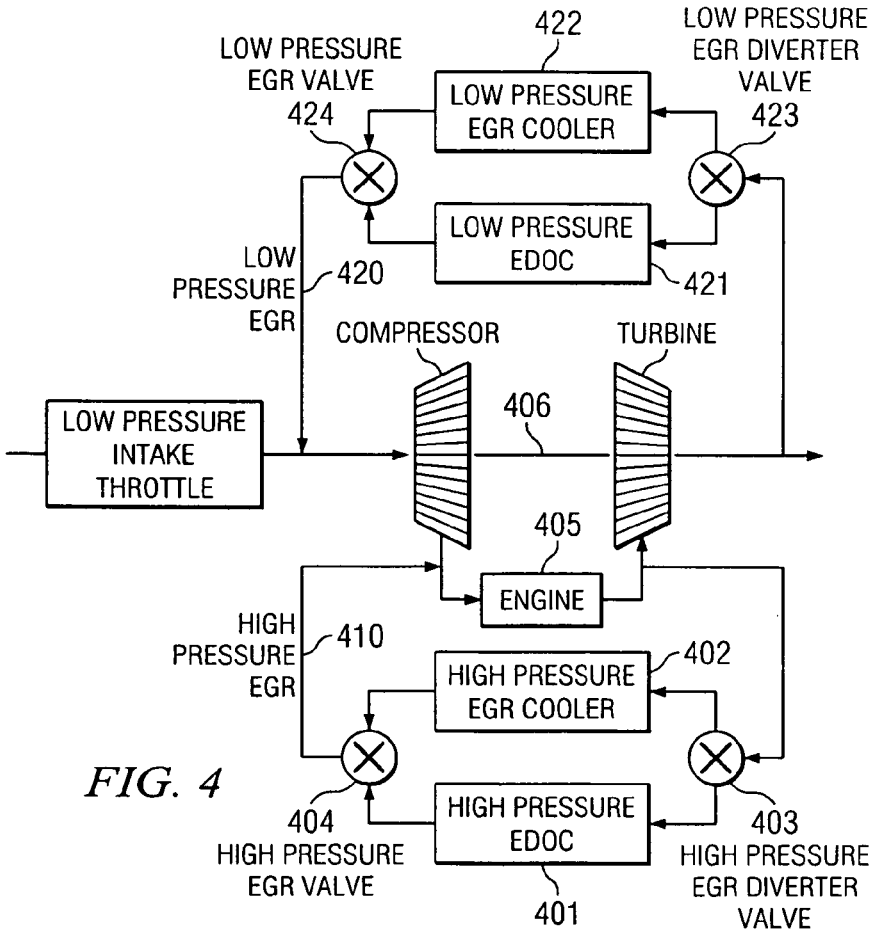
FIG. 4 illustrates a combined LPL and HPL EGR system in accordance with the invention.

FIG. 4 illustrates another embodiment of the invention. System 400 is used with an engine 405 having a turbocharger 406. The EGR system has a HPL EGR loop 410 as well as a LPL EGR loop 420. It should be understood that the LPL EGR loop 420 could also be used without the HPL EGR loop 410.

The HPL EGR loop 410 is similar to system 300 of FIG. 3, having a dual-leg configuration, with an EDOC 401, cooler 402, and valves 403 and 404.

The LPL EGR loop 420 has a similar dual-leg configuration, with an EDOC 421, cooler 422, and valves 423 and 424. The LPL EGR temperature is controlled through EGR cooler 422 when low temperature and high EGR rate is required. It is controlled through low pressure EGR catalyst 421 when high temperature but high EGR rate is needed.

As in system 300, alternative embodiments of system 400 might permit EGR gas to flow through both legs of either dual-leg segment. Thus, valves 403 and 404 or valves 423 and 424 could be controlled to permit a mix of heated and cooled EGR gas.

Referring to both FIGS. 3 and 4, for any of the high temperature legs (the leg having the EDOC), a thermal insulator could be used to eliminate heat loss and further increase the temperature of EGR when its reaches the engine.

Both systems 300 and 400 feature a dual-leg HPL EGR system with the option of allowing EGR cooling or EGR heating. System 400 further provides this option in a LPL EGR system. Both systems may be operated such that EGR cooling will be applied under normal running conditions and especially under high load conditions. EGR heating may be applied at low engine load conditions as well as cold starting.

Controller 310 is programmed to command operating mode switchovers in response to various measured or calculated values. For example, valve 303 or 403 may be activated in response to engine temperature as measured by engine coolant temperature. Controller 301 may also use time as a control parameter, or other measured or calculated values.

The above-described EGR temperature control method provides for fast EDOC warm up through post-injection or retarded main injection. Heated EGR permits alternative combustion for exhaust treatment system heat management.

It should be understood that the various engine operating conditions described herein are not definite in duration. For example, during an operating condition such as "low load condition" or "warm-up time", heated or cooled EGR may be provided for all or a portion of that time.

What is claimed is:

1. A high-pressure loop exhaust gas recirculation (EGR) system for recirculating exhaust from an engine, the engine having an air intake line, a turbocharger, and a primary exhaust line, comprising:

an EGR loop for carrying EGR gas, the loop branching from the primary exhaust line upstream the turbine of the turbocharger and entering the engine air intake line downstream the compressor of the turbocharger;

a dual-leg segment of the EGR loop, a first leg having an EGR cooler and a second leg having an EGR heater; and a diverter valve at the input to the dual-leg segment, the diverter valve operable to control the amount of EGR flow through the first leg relative to the second leg;

wherein, downstream the cooler and the heater, the first leg and the second leg are rejoined to a single flow in the EGR loop.

2. The system of claim 1, further comprising an EGR control valve at the point where the first leg and the second leg are rejoined.

3. The system of claim 1, further comprising a thermal insulator associated with the second leg.

4. The system of claim 1, wherein the engine is a diesel engine.

5. The system of claim 1, wherein the heater is a catalyst.

6. A low pressure loop exhaust gas recirculation (EGR) system for recirculating exhaust from an engine, the engine having an air intake line, a turbocharger, and a primary exhaust line, comprising:

an EGR loop for carrying EGR gas, the loop branching from the primary exhaust line downstream the turbine of the turbocharger and entering the engine air intake line upstream the compressor of the turbocharger;

a dual-leg segment of the EGR loop, a first leg having an EGR cooler and a second leg having an EGR heater; and a diverter valve at the input to the dual-leg segment, the diverter valve operable to control the amount of EGR flow through the first leg relative to the second leg;

wherein, downstream the cooler and the heater, the first leg and the second leg are rejoined to a single flow in the EGR loop.

7. The system of claim 6, further comprising an EGR control valve at the point where the first leg and the second leg are rejoined.

8. The system of claim 6, further comprising a thermal insulator associated with the second leg.

9. The system of claim 6, wherein the engine is a diesel engine.

10. The system of claim 6, wherein the heater is a catalyst.

11. A method of controlling the temperature of recirculated exhaust gas in an exhaust gas recirculation (EGR) system of an engine having an air intake line, a turbocharger, and a primary exhaust line, the method comprising:

recirculating exhaust gas via an EGR loop, the loop branching from the primary exhaust line and entering the engine air intake line;

wherein the loop has a dual-leg segment, with a first leg having an EGR cooler and a second leg having a EGR heater; and using a diverter valve at the input to the dual-leg segment to control the amount of EGR flow through the first leg relative to the second leg.

12. The method of claim 11, wherein the EGR system is a high pressure loop system.

13. The method of claim 11, wherein the EGR system is a low pressure loop system.

14. The method of claim 11, further comprising using an EGR control valve at the point where the first leg and the second leg are rejoined to further control the flow of EGR.

15. The method of claim 11, further comprising using a thermal insulator associated with the second leg to reduce EGR heat loss.

16. The method of claim 11, wherein the engine is a diesel engine.

17. The method of claim 11, wherein the EGR heater is a catalyst.

18. The method of claim 11, wherein the engine has an aftertreatment device on the primary exhaust line, and further comprising increasing the relative flow through the first leg in response to operating conditions associated with the aftertreatment device.

19. The method of claim 11, further comprising increasing the relative flow through the second leg in response to engine load conditions.

20. The method of claim 11, wherein the diverter valve is controlled by signals from an engine control unit.

21. The method of claim 11, further comprising increasing the relative flow through the second leg during cold start conditions of the engine.

* * * * *